US006759935B2

(12) United States Patent
Moro et al.

(10) Patent No.: US 6,759,935 B2
(45) Date of Patent: Jul. 6, 2004

(54) COIL-EMBEDDED DUST CORE PRODUCTION PROCESS, AND COIL-EMBEDDED DUST CORE FORMED BY THE PRODUCTION PROCESS

(75) Inventors: Hideharu Moro, Tokyo (JP); Tsuneo Suzuki, Tokyo (JP); Tsutomu Chou, Tokyo (JP); Jyunetsu Tamura, Tokyo (JP); Sadaki Sato, Tokyo (JP)

(73) Assignee: TDK Corporation, Tokyo (JP)

( * ) Notice: Subject to any disclaimer, the term of this patent is extended or adjusted under 35 U.S.C. 154(b) by 355 days.

(21) Appl. No.: 09/754,126

(22) Filed: Jan. 5, 2001

(65) Prior Publication Data

US 2001/0016977 A1 Aug. 30, 2001

(30) Foreign Application Priority Data

Jan. 12, 2000 (JP) ..... 2000-003506
Dec. 6, 2000 (JP) ..... 2000-371541

(51) Int. Cl.[7] ..... H01F 27/02; H01F 7/06

(52) U.S. Cl. ..... 336/83; 29/602.1; 29/605; 29/729; 29/606; 336/90; 336/92; 336/200

(58) Field of Search ..... 29/606, 602.1, 29/729, 605; 336/233, 177, 90, 96, 83, 200; 264/272.19, 113, 125

(56) References Cited

U.S. PATENT DOCUMENTS 5,935,722 A * 8/1999 Moorhead et al. ..... 428/694 B
6,102,980 A * 8/2000 Endo et al. ..... 75/252
6,392,525 B1 * 5/2002 Kato et al. ..... 336/233
2001/0011697 A1 * 8/2001 Moro et al. ..... 29/606
2002/0158739 A1 * 10/2002 Shibata et al. ..... 336/90

FOREIGN PATENT DOCUMENTS

| | | | |
|---|---|---|---|
| JP | 58-132907 | * | 8/1883 |
| JP | 54-28577 | | 9/1979 |
| JP | 3-52204 | | 3/1991 |
| JP | 2958807 | | 7/1999 |
| JP | 11-273980 | | 10/1999 |
| JP | 2000-36429 | * | 2/2000 |
| JP | 3108931 | | 9/2000 |

* cited by examiner

*Primary Examiner*—Minh Trinh
(74) *Attorney, Agent, or Firm*—Oblon, Spivak, McClelland, Maier & Neustadt, P.C.

(57) ABSTRACT

The invention provides a process for producing a coil-embedded dust core by embedding a coil in magnetic powders comprising ferromagnetic metal particles coated with an insulating material. At the first compression molding step one portion of magnetic powders is filled in a molding die and then compression molded to form a lower core. At a coil positioning step the coil is positioned on the upper surface of the lower core in the molding die. At a coil embedding step another portion of magnetic powders is again filled in the molding die in such a way that the coil is embedded in these magnetic powders. At the second compression molding step pressure is applied to the lower core and coil in the direction of lamination thereof.

16 Claims, 5 Drawing Sheets

10 μm

COIL-EMBEDDED DUST CORE PRODUCTION PROCESS, AND COIL-EMBEDDED DUST CORE FORMED BY THE PRODUCTION PROCESS

FIELD OF THE INVENTION

The present invention relates generally to an inductor used for choke coils or other electronic parts, and more particularly to a coil-embedded dust core wherein a coil is embedded in a dust core, and its production process.

BACKGROUND ART

Recently achieved size reductions of electric, and electronic equipment result in the need of miniature yet high-efficiency dust cores. For the dust cores, ferrite powders and ferromagnetic metal powders are used. The ferromagnetic metal powders allow magnetic cores to decrease in size because of being higher in saturation flux density than the ferrite powders, but cause magnetic cores to have increased eddy-current looses because of their lower electrical resistance. For this reason, the surfaces of ferromagnetic metal particles in a dust core are usually provided with an insulating layer.

To achieve further size reductions of an inductor comprising a dust core, it is proposed to obtain an inductor of a structure wherein a coil is embedded in a dust core by compression molding of magnetic powders with the coil embedded therein. The inductor of this structure is herein called a coil-embedded dust core, typical examples of which are set forth in U.S. Pat. No. 2,958,807, JP-A 11-273980 and JP-B 54-28577. The coil-embedded dust cores disclosed in these publications are all produced by one single compression molding of magnetic powders and a coil charged in a molding die.

U.S. Pat. No. 3,108,931 discloses a process for producing an inductor similar to the coil-embedded dust core by compression molding of powder compacts with a coil sandwiched between them.

JP-A 3-52204 discloses a process for obtaining an inductance element similar to the coil-embedded dust core by preparing a resin ferrite core having a protrusion at its center and a resin ferrite core having a recess in its center by compression molding, coating some portions of the protrusion and a coil with an adhesive resin, applying pressure to the projection and recess fitted to the coil, and curing the adhesive resin.

Upon investigation of coil-embedded dust cores obtained by one single compression molding of a coil and magnetic powders charged in a mold as set forth in each of the first-mentioned three publications, the inventors have now found that the position of coils is prone to variations in the dust cores. Variations in the position of a coil in a dust core lead to variations in the magnetic path length and section area of the inductor, ending up with variations in the magnetic properties of the inductor. It has also been found that any deviation of the coil from its proper position in the dust core makes the coil-embedded dust core likely to crack. Any displacement of the coil from its proper position in the dust core causes local magnetic saturation, resulting in decreased inductance. Also, this may otherwise cause flux leakage from the side of the dust core nearer to the coil to become large and, hence, have some influences on an element in the vicinity of the dust core.

According to the process disclosed in U.S. Pat. No. 3,108,931, as recited in the scope of what is claimed, the first and second powder compacts are provided by pre-compression molding. Then, the first and second powder compacts are placed one over another with a coil interposed between them, and then compression molded until the interface between the first and second powder compacts is removed, thereby producing an inductor.

It is true that U.S. Pat No. 3,108,931 teaches that metal-based magnetic powders may be used; however, only ferrite powders are exemplified for the magnetic powders used therein. When powder compacts comprising metal powders are used according to the process disclosed in that patent to produce an inductor, it is more difficult to bond the first and second powder compacts together as compared with the use of powder compacts comprising ferrite powders. In other words, both powder compacts cannot be bonded together with no application of an extremely high molding pressure. Nonetheless, gaps or cracks occur between both powder compacts, and so the resultant inductor becomes poor in mechanical strength and less than satisfactory in appearance as well. On the other hand, when both powder compacts are molded at a pressure high enough to make a nearly perfect junction between them, an insulation failure occurs due to crushing of the embedded coil.

In the first example of U.S. Pat. No. 3,108,931, the second powder compact 11 is inserted into a lower molding die 10 while the first powder compact 6 molded in a cap form in an upper molding die 7 is left as such therein, as shown in FIG. 3. Then, both powder compacts are compression molded with a coil 5 interposed between them. In the second example, the first powder compact 26 of E-shape in section is molded in an upper molding die 27 and the second powder compact 34 of E-shape in section is molded in a lower molding die 30, as shown in FIG. 8. Then, both powder compacts are compression molded with a coil 5 interposed between them, while the first and second powder compacts are left as such in the upper and lower molding dies, respectively. However, the fact that the first powder compact 6 or 26 remains tightly held in the upper molding die 7 or 27 means that when the inductor is released from the mold assembly after compression molding, it is required to forcibly eject the inductor from the mold assembly by descending the upper punch. Thus, the process set forth in U.S. Pat. No. 3,108,931 does not lend itself to mass-production because of needing many releasing operations and, hence, low molding efficiency.

According to the process set forth in JP-A 3-52204 —which process does not rely on any compression molding of magnetic powders with a coil embedded therein, a coil is interposed between a pair of resin ferrite cores already subjected to compression molding, which are then compressed at a low pressure (of about 20 kg/cm$^2$) and bonded together by use of an adhesive resin. For this reason, gaps are likely to occur between both cores. Now, such an inductor must be capable of being used as a surface mount device. However, the inductor disclosed in JP-A 3-52204 is of low heat resistance because the resin ferrite cores are bonded together by the resin. In other words, a problem with this inductor is that the resin ferrite cores are prone to separation from each other at a soldering step of the surface mount process.

SUMMARY OF THE INVENTION

An object of the present invention is to provide a coil-embedded dust core with a limited variation in the position of the coil located in the core. Another object of the present invention is to improve the mechanical strength of such a coil-embedded dust core. Yet another object of the present invention is to increase the productivity of such a coil-embedded dust core.

These and other objects are achieved by the embodiments of the invention as recited below.

(1) A process for producing a coil-embedded dust core by embedding a coil in magnetic powders comprising ferromagnetic metal particles coated with an insulating material, which includes:

a first compression molding step wherein one portion of magnetic powders is filled in a molding die and then compression molded to form a lower core, a coil positioning step wherein said coil is positioned on an upper surface of said lower core in said molding die, a coil embedding step wherein another portion of magnetic powders is again filled in said molding die in such a way that said coil is embedded in magnetic powders, and a second compression molding step wherein pressure is applied to said lower core and said coil in a direction of lamination thereof.

(2) The coil-embedded dust core production process according to (1) above, which satisfies $$1 \leqq P_2/P_1$$

where $P_1$ is a pressure applied at said first compression molding step and $P_2$ is a pressure applied at said second compression molding step.

(3) The coil-embedded dust core production process according to (1) above, which satisfies $$1 < P_2/P_1$$

where $P_1$ is a pressure applied at said first compression molding step and $P_2$ is a pressure applied at said second compression molding step.

(4) The coil-embedded dust core production process according to (1) above, wherein:

said coil is a single-wound coil formed of a conductor wire of flat shape in section, said conductor wire is wound in such a way that a major diameter direction of said flat section is perpendicular with respect to an axial direction of said coil, said conductor wire is fixed at one end and another end with terminal electrodes, respectively, and where said coil is positioned on the upper surface of said lower core, the terminal electrode located relatively near to said lower core is positioned on an upper surface of said conductor wire while the terminal electrode located relatively far away from said lower core is positioned on a lower surface of said conductor wire.

(5) The coil-embedded dust core production process according to (1) above, wherein the upper surface of said lower core is provided with at least one protrusion that is located on an inner and/or outer periphery of said coil.

(6) The coil-embedded dust core production process according to (5) above, wherein at least one of said protrusions, $Ch \neq Dh/2$, where Ch is a height of said protrusion, and Dh is a height of the coil-embedded dust core to be produced.

(7) The coil-embedded dust core production process according to (1) above, wherein $Bh \neq Dh/2$, where Bh is a height of a surface of said lower core on which said coil is positioned, and Dh is a height of the coil-embedded dust core to be produced.

(8) The coil-embedded dust core production process according to (1) above, wherein the ferromagnetic powders used comprises ferromagnetic metal particles where the number of ferromagnetic metal particles having a circularity of 0.5 or less as defined by the following equation (I) accounts for 20% or less of all ferromagnetic metal particles:

$$\text{circularity} = 4\pi S/L^2 \quad \text{(I)}$$

where S is an area of a projected image of a particle, and L is a length of a profile of said projected image.

(9) The coil-embedded dust core production process according to (1) above, wherein the ferromagnetic metal particles used are formed of an alloy composed primarily of Fe and Ni.

(10) A coil-embedded dust core produced by the production process according to (1) above.

The inventors have now found that there is a variation in the position of a coil in a conventionally produced coil-embedded dust core for the reasons that when the coil and magnetic powders are charged in a molding die, it is difficult to hold the coil at a constant position in the molding die, and during compression molding, the coil goes down with varying amounts in the pressure application direction even when the constant pressure is applied.

In the present invention, on the other hand, only the first portion of magnetic powders is compression molded at the first compression molding step to form a lower core. Then, a coil is positioned on the upper surface of the lower core, and another portion of magnetic powders is thereafter filled for the second compression molding to form an upper core, thereby obtaining a coil-embedded dust core. By preforming the lower core in this way, the coil can be substantially prevented from going down during the second compression molding, and the coil can be precisely positioned prior to the second compression molding, so that the variation in the position of the core in the coil-embedded dust core can be much more reduced than ever before.

In the present invention, the lower core of the coil-embedded dust core is formed at the first compression molding step and the upper core of the coil-embedded dust core is formed at the second compression molding step. When compression molding is carried out at two stages as in the present invention, cracks may possibly occur between the lower core and the upper core due to insufficient adhesion between them. In the present invention, accordingly, there should be a relationship between the pressure $P_1$ applied at the first compression molding step and the pressure $P_2$ applied at the second compression molding step, such that usually $1 \leqq P_2/P_1$, and preferably $1 < P_2/P_1$. By limiting $P_2/P_1$ to within the preferable range, it is thus possible to substantially prevent cracks from occurring between both cores.

BRIEF DESCRIPTION OF THE ACCOMPANYING DRAWINGS

DESCRIPTION OF THE PREFERRED EMBODIMENTS

Coil-Embedded Dust Core Production Process

FIGS. 1A through 1D illustrate the process flow in the production process of the present invention.

Figure 1A:
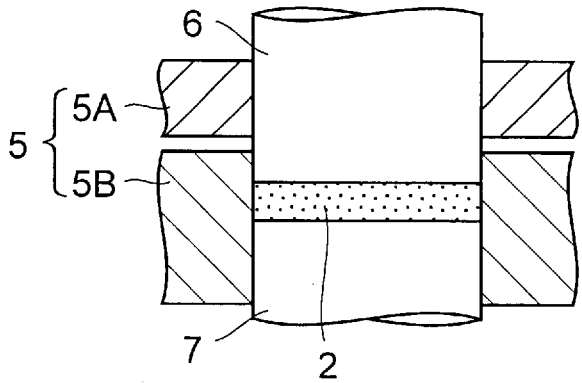
FIG. 1A is a sectional schematic illustrative of the first compression molding step in the production process of the invention.
Figure 1B:
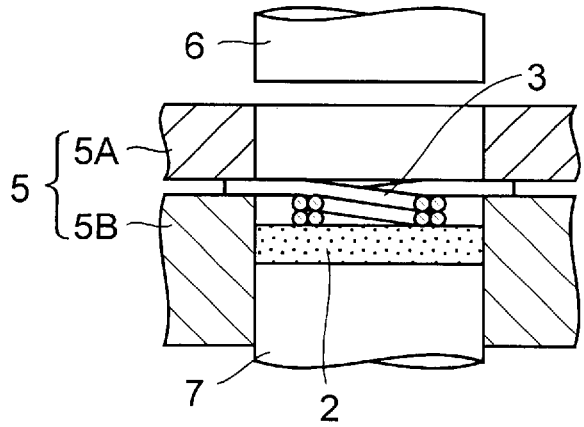
FIG. 1B is a sectional schematic of the coil positioning step in the production process of the invention.
Figure 1C:
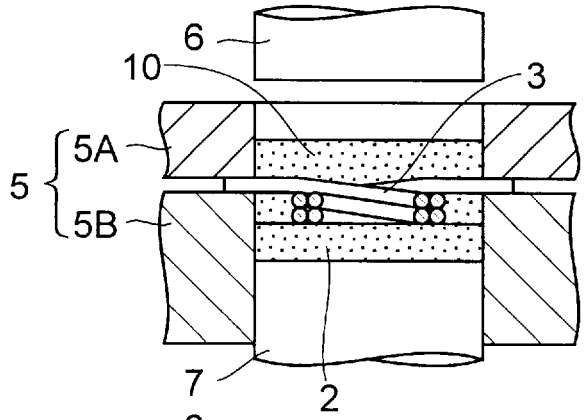
FIG. 1C is a sectional schematic of the coil embedding step in the production process of the invention.
Figure 1D:
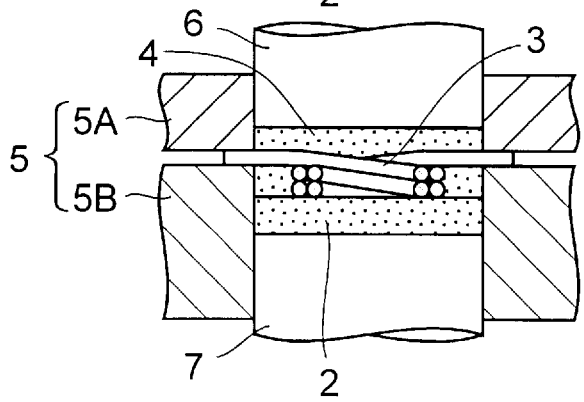
FIG. 1D is a sectional schematic of the second compression molding step in the production process of the invention.

According to the present invention, the coil-embedded dust core is produced by embedding a coil in magnetic powders comprising ferromagnetic metal particles coated with an insulating material. The production process of the invention comprises:

the first compression molding step wherein, as shown in FIG. 1A, one portion of magnetic powders is first filled in a molding die built up of a frame 5, an upper punch 6 and a lower punch 7, and then compression molded therein to form a lower core 2 of the coil-embedded dust core, the coil positioning step wherein, as shown in FIG. 1B, a coil 3 is positioned on the lower core 2 in the molding die, the coil embedding step wherein, as shown FIG. 1C, another portion 10 of magnetic powders is again filled in the molding die in such a way that the coil 3 is embedded in the magnetic powders, and the second compression molding wherein, as shown in FIG. 1D, pressure is applied to the lower core 2 and coil 3 in the direction of lamination thereof for compression molding, thereby forming an upper core 4.

The molding conditions for the first, and second compression molding step are not particularly limited; they may be optionally determined depending on the type, shape and size of ferromagnetic metal particles, the shape, size and density of the coil-embedded dust core, etc. However, the maximum pressure should be of the order of usually 100 to 1,000 MPa, and preferably 100 to 600 MPa, and the time during which the core or cores are held at the maximum pressure should be of the order of 0.1 second to 1 minute. At too low a molding pressure, it is difficult to obtain satisfactory characteristics and mechanical strength. At too high a molding pressure, on the other hand, the coil is prone to short-circuit.

Here let $P_1$ and $P_2$ stand for the pressures applied at the first and second compression molding steps, respectively. Then, usually $1 \leqq P_2/P_1$, preferably $1 < P_2/P_1$, more preferably $1.1 \leqq P_2/P_1$, and even more preferably $2 \leqq P_2/P_1$.

In the present invention, the lower core of the coil-embedded dust core is formed at the first compression molding step and the upper core of the coil-embedded dust core is formed at the second compression molding step. When compression molding is carried out at two stages as in the present invention, cracks may possibly occur between the lower core and the upper core due to insufficient adhesion between them. Especially, cracks are likely to occur in the vicinity of terminal electrodes that are connected to both ends of the coil. By limiting the $P_1$ versus $P_2$ relation to within the aforesaid preferable range, however, it is possible to substantially prevent the occurrence of cracks between both cores. However, it is noted that when the ratio of $P_2$ with respect to $P_1$ is too large, $P_1$ becomes too low or $P_2$ becomes too high. This in turn makes it difficult to obtain satisfactory properties and mechanical strength, or the coil prone to short-circuit. It is thus preferable that $$P_2/P_1 \leqq 5$$

Although no particular limitation is imposed on the thickness of the lower core 2, the thickness of the lower core 2 should preferably be determined in such a way that the coil 3 is positioned substantially centrally in the coil-embedded dust core.

At the coil positioning step, the coil 3 should preferably be fixed to the frame 5, as shown in FIG. 1B. As a result, the coil 3 is less likely to move at the coil-embedding step and the second compression molding step, so that the variation in the position of the coil in the coil-embedded dust core can be much more reduced. In the illustrated embodiment, the frame 5 is split into two parts, i.e., an upper frame part 5A and a lower frame part 5B, so that the coil 3 can be fixed to the frame 5 by interposing the ends of the coil 3 between the upper and lower frame parts 5A and 5B. In addition to such a fixing method, it is also acceptable to make use of a method wherein terminal electrodes are previously fixed to both ends of the coil 3 or a lead frame having conductors providing terminal electrodes is fixed to the coil 3, so that the terminal electrodes or lead frame can be fixed to the frame. It is here noted that when the lead frame is used to fix the terminal electrodes to the coil, only the cutting of the frame body after powder compaction is needed.

Figure 3:
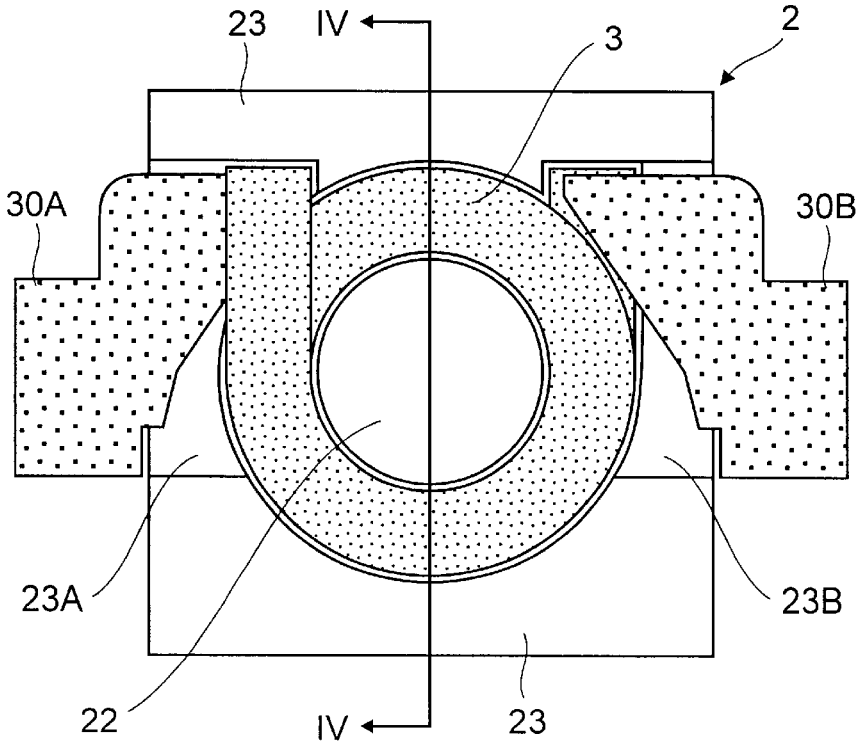
FIG. 3 is a plan view illustrative of the coil positioned on the lower core.

When the coil 3 or the terminal electrodes or lead frame connected thereto is interposed and fixed between the upper and lower frame parts, it is desired that the coil 3 be of double-wound construction as shown, because both ends of the coil 3 can have substantially the same height. For the coil 3 of double-wound construction, however, it is required that the coil-forming conductor wire cross over itself. The surface of the conductor wire is provided with an insulating coating, and so this insulating coating is susceptible to damage at the positions where the conductor wire cross over itself. As a result, a short-circuit may often occur between the conductor wire windings. To prevent such a short-circuit, the coil 3 should preferably be of single-wound construction, as shown in FIG. 3.

However, it is noted that when the coil 3 is of single-wound construction, the coil 3 becomes thick, and that when the coil 3 is positioned on the upper surface of the lower core 2, there is a large difference in height between both its ends. To provide a solution to such a problem, it is preferable to use a coil made up of a conductor wire of rectangular, elliptical or other flat shape in section, in which coil the conductor wire is wound with the major diameter direction of the flat section being perpendicular with respect of the axial direction of the coil. This ensures that the current path can have a sectional area so sufficient that direct-current resistance can be reduced, and makes it possible to reduce the overall thickness of the coil. In this case, the aspect ratio of the flat section of the coil may be optionally determined depending on the demanded sectional area and overall height of the coil. Usually, however, it is preferable that the major to minor diameter ratio of the coil is in the range of 5 to 20.

At the coil positioning step for positioning the coil 3, it is preferable that the axial direction of the coil 3 is in substantial coincidence with the pressure application direction at the second compression molding step, as shown in FIG. 1B. This makes the coil less susceptible to distortion at the second compression molding step, thereby preventing its deterioration.

Referring here to FIG. 1A, the upper surface of the lower core 2 is flattened at the first compression molding step. If, in this case, the coil 3 is fixed to the frame 5 as shown in FIG. 1B, it is then possible to reduce movement of the coil 3 in the horizontal plane direction to a sufficient level. However, it is preferable to provide the upper surface of the lower core 2 with at least one protrusion that is located on the inner and/or outer periphery of the coil 3. If this protrusion is used for the positioning of the coil 3, it is then possible to prevent movement of the coil 3 on the upper surface of the lower core 2 in its plane direction and prevent any misalignment of the coil 3 upon positioned on the upper surface of the lower core 2. Accordingly, it is possible to obtain a coil-embedded dust core less susceptible to performance variations.

One embodiment of the present invention where the protrusions are provided on the upper surface of the lower core 2 is now explained.

Figure 2:
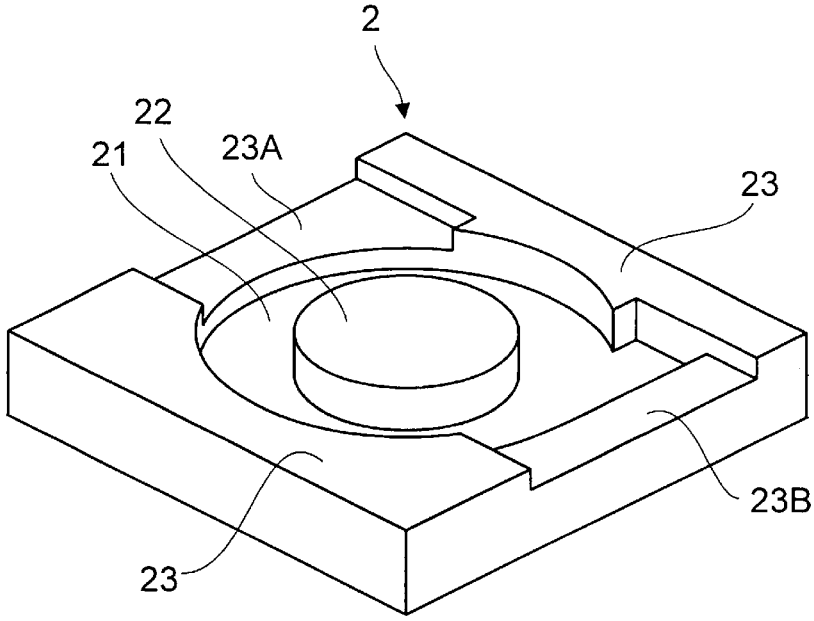
FIG. 2 is a perspective view illustrative of the lower core.

FIG. 2 is a perspective view of the lower core 2, and FIG. 3 is a plan view of the coil 3 positioned on the upper surface of the lower core 2. This lower core 2 of square shape in plane comprises an upper coil-positioning surface 21. The upper coil-positioning surface 21 is provided thereon with an inner protrusion 22 and an outer protrusion 23. The inner protrusion 22 is in a columnar form having an outside diameter slightly smaller than the inside diameter of the coil 3, and the outer protrusion 23 is in a cylindrical form having an inside diameter slightly larger than the outside periphery of the coil 3. The coil 3 is then positioned on a substantial ring form of groove (the coil positioned surface 21) defined between the inner protrusion 22 and the outer protrusion 23.

The coil 3 is a single-wound coil of 2.6 turns made up of a conductor wire of flat shape in section. Terminal electrodes 30A and 30B are fixed to both ends of the coil 3. The terminal electrode 30A located relatively far away from the lower core 2 and the terminal electrode 30B located relatively near to the lower core 2 are fixed to the lower and upper surfaces of the conductor wire, respectively, so that the difference in height between the terminal electrode 30A and the terminal electrode 30B can be smaller than the thickness of the coil 3. The outer protrusion 23 is recessed at 23A and 23B corresponding to positions out of which the terminal electrodes 30A and 30B are led.

The heights of the recesses 23A and 23B are set at a middle point between the height of the terminal electrode 30A and that of the terminal electrode 30B, and the terminal electrodes 30A and 30B are positioned on the recesses 23A and 23B, respectively, so that the terminal electrodes 30A and 30B can be led outwardly from the lower core 2 while they are less susceptible to flexion and bending. With this arrangement, the region unfilled with magnetic powders is less likely to occur when the upper core is formed, and so a coil-embedded dust core excellent in strength and performance can be obtained. It is here noted that the recesses 23A and 23B are each allowed to have a height in substantial coincidence with heights with which the terminal electrodes 30A and 30B are provided.

It is understood that the coil-embedded dust core of the present invention is usually as a surface mount device, and so the terminal electrodes 30A and 30B are bent after the formation of the coil-embedded dust core, with both its ends coming into close contact with the upper or lower surface of the core.

Figure 4:
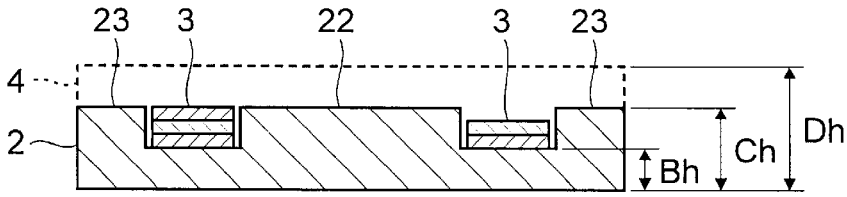
FIG. 4 is a sectional view as taken along IV—IV line of FIG. 3.

FIG. 4 is a sectional schematic of the lower core 2 as taken along line IV—IV of FIG. 3. In the present invention, there should preferably be a relation between the height, Ch, of the apex surface of the inner protrusion 22, and the outer protrusion 23 and the height, Dh, of the coil-embedded dust core, such that $Ch \neq Dh/2$. There should also be a relation between the height, Bh, of the coil positioning surface 21 and Dh, such that $Bh \neq Dh/2$. Set out is why these relations should be satisfied.

At the second compression molding step, the magnetic powders are compressed while they are sandwiched between the lower core and the upper punch. In this condition, the applied pressure becomes lowest at an intermediate position between the lower punch and the upper punch rather than at an intermediate position between the lower core and the upper punch. For this reason, if the vicinity of a boundary between the lower core 2 and the upper core 4 is located at the intermediate position between the upper punch and the lower punch upon completion of pressure application, adhesion between both cores tends to become insufficient. This in turn makes cracking likely to occur in the vicinity of the boundary between both cores. Cracking is also likely to occur between both cores when the terminal electrodes are bent. Such cracking can be prevented if $Ch \neq Dh/2$ and $Bh \neq Dh/2$ where Ch is the height of the protrusion, Bh is the height of the coil positioning surface, and Dh is the height of the coil-embedded dust core, because the boundary between the lower core 3 and the upper core 4 vanishes at the position where the applied pressure becomes lowest at the second compression molding step.

In FIG. 4, the height of the inner protrusion 22 is shown to be flush with the outer protrusion 23; however, these heights may be different from each other. Preferably in this case, at least one or both of the heights of the inner and outer protrusions do not equal to Dh/2.

The relations between the height, Bh, of the coil positioning surface as well as the height, Ch, of the protrusion and the height, Dh, of the coil-embedded dust core may be appropriately determined in such a way as to prevent cracking. To be more specific, it is preferable that $0.2 \leqq Bh/Dh \leqq 0.4$ or, alternatively, $0.6 \leqq Bh/Dh \leqq 0.7$ with the proviso that no protrusion is provided on the coil positioning surface. To locate the coil 3 substantially at the center of the coil-embedded dust core, however, it is preferable that $0.2 \leqq Bh/Dh \leqq 0.4$. When the protrusion is provided on the coil positioning surface, on the other hand, it is preferable that $0.2 \leqq Bh/Dh \leqq 0.4$, and $0.6 \leqq Ch/Dh \leqq 0.8$.

The lower core having protrusions on its upper surface may be produced using a molding die corresponding to the pattern and size of the protrusions to be provided. However, it is preferable to use a servo pressing machine for two- or multi-stage compression molding, because the density of the resultant core becomes uniform. FIGS. 5A through 5I illustrate together a specific process flow for two-stage compression molding.

Figure 5A:
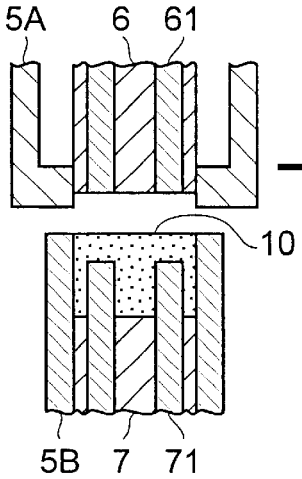
FIG. 5A is a sectional view of the process flow in the production process of the invention.

For this process, there is provided a molding machine comprising a frame assembly split into an upper frame 5A and a lower frame 5B, an upper punch assembly 6 with a built-in upper inner punch 61 and a lower punch assembly 7 with a built-in lower inner punch 71, as shown in FIG. 5A. The upper inner punch 61 and lower inner punch 71 have a planar shape compatible with the pattern of protrusions formed on the lower core.

As shown in FIG. 5A, magnetic powders 10 are first filled in a molding cavity defined by the lower frame 5B and the lower punch assembly 7. At this time, the lower inner punch 71 is located in its uppermost position.

Figure 5B:
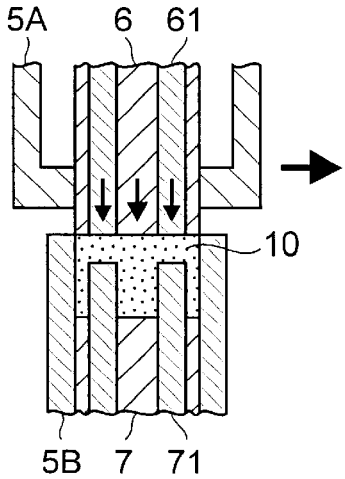
FIG. 5B is a sectional view of the process flow in the production process of the invention.

Then, the upper punch assembly 6 including the upper inner punch 61 is moved down until it comes into contact with the upper surface of the magnetic powders 10, as shown in FIG. 5B.

Figure 5C:
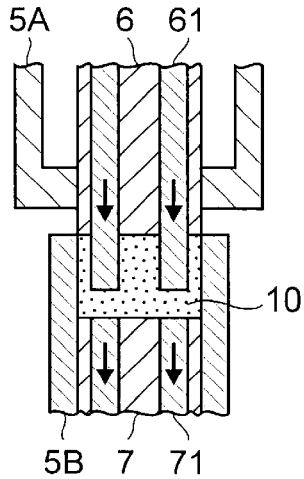
FIG. 5C is a sectional view of the process flow in the production process of the invention.

Then, the upper inner punch 61 and lower inner punch 71 are moved down in a synchronized manner, as shown in FIG. 5C.

Figure 5D:
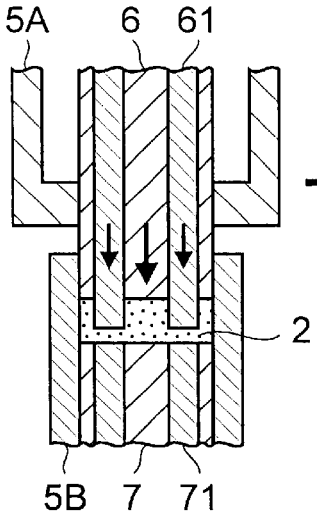
FIG. 5D is a sectional view of the process flow in the production process of the invention.

Then, the upper punch assembly 6 including the upper inner punch 61 is moved down, as shown in FIG. 5D, thereby carrying out the first compression molding step. In this case, it is not required to move down the upper punch assembly 6 in its entirety; however, care must be taken to be sure that the same compressibility is achievable at a region just below the upper inner punch 61 and other region by independent control of the amount of downward movement of the upper inner punch 61. This control operation enables all magnetic powders to be compressed at uniform compressibility, so that the lower core 2 having protrusions on its upper surface can be obtained at uniform density.

Figure 5E:
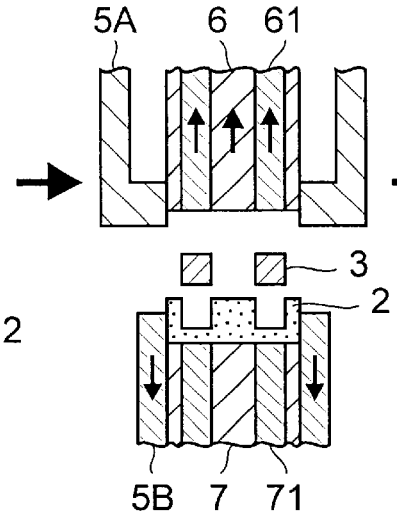
FIG. 5E is a sectional view of the process flow in the production process of the invention.

Then, the upper punch assembly 6 is moved up, as shown in FIG. 5E, whereupon the a coil 3 with terminal electrodes (not shown) fixed thereto (or with a lead frame having terminal electrodes fixed thereto) is positioned on the upper surface of the thus formed lower core 2. At this time, the lower frame 5B is moved down to a position where its upper surface is flush with the terminal electrodes.

Figure 5F:
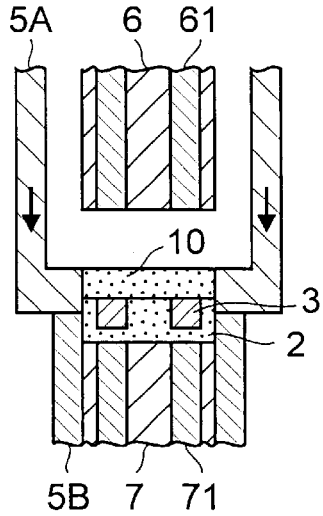
FIG. 5F is a sectional view of the process flow in the production process of the invention.

Then, the upper frame 5A is moved down as shown in FIG. 5F, whereupon the terminal electrodes are interposed and fixed between the upper frame 5A and the lower frame 5B. Then, magnetic powders 10 are filled in a molding cavity defined by the lower core 2 and the upper frame 5A.

Figure 5G:
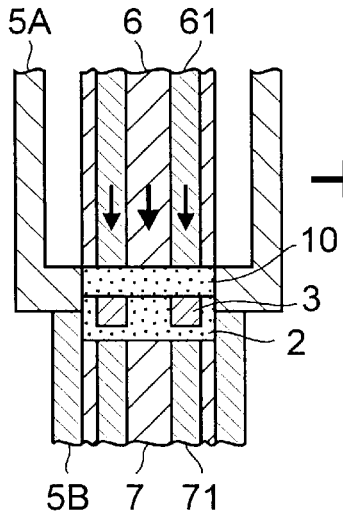
FIG. 5G is a sectional view of the process flow in the production process of the invention.
Figure 5H:
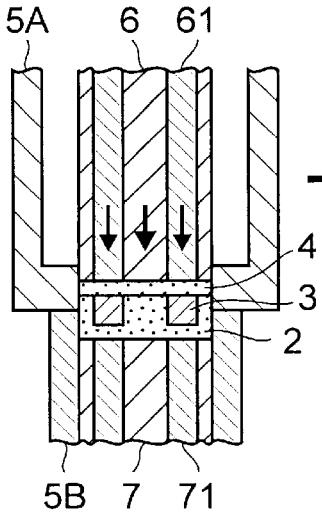
FIG. 5H is a sectional view of the process flow in the production process of the invention.

Then, the upper punch assembly 6 is moved down as shown in FIGS. 5G and 5H to compress the magnetic powders 10, thereby forming an upper core 4 and, hence, obtaining a coil-embedded dust core (the second compression molding step).

Figure 5I:
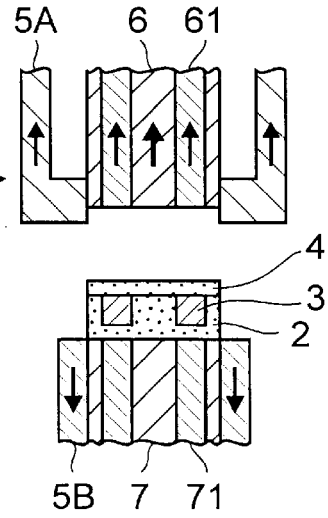
FIG. 5I is a sectional view of the process flow in the production process of the invention.

Then, the upper frame 5A and the upper punch assembly 6 are moved up while the lower frame 5B is moved down, as shown in FIG. 5I, whereupon the coil-embedded dust core is removed from the molding machine.

In the coil-embedded dust core produced by such a multi-stage molding process, usually, a pattern corresponding to the profile of the inner punch is found on the surface of the upper core and the surface of the lower core. It is understood that when the coil-embedded dust core of the present invention is used as a surface mount device as already explained, the terminal electrodes must be in close contact with the surface of the upper core or the surface of the lower core. In this case, it is acceptable to provide the surface of the upper or lower core with recesses for receiving the terminal electrodes, thereby achieving a structure wherein the terminal electrodes do not project from the surface of the core.

In the present invention, the compression molding is carried out at two stages, as explained above. Otherwise, the molding conditions are not critical. Some specific examples of other preferable conditions or production procedures are set out below.

When the present invention is carried out using iron powders as the magnetic powders, it is preferable to heat-treat (anneal) the iron powders for distortion removal prior to coating of an insulating material thereon. Before coating, the iron powders may also be oxidized. If an oxide film as thin as a few tens of nanometers is formed in the vicinity of the surfaces of iron particles by this oxidization, some improvements in insulation are then expected. For oxidization, heating may be carried out in an oxidizing atmosphere such as air at 150 to 300° C. for approximately 0.1 to 2 hours. With oxidization, the iron particles may be mixed with a dispersant such as ethyl cellulose so as to improve the wettability of the surfaces of the iron particles.

For the insulating material, at least one material may be appropriately selected from such various inorganic material and organic materials as described later. Coating conditions are not critical; for instance, mixing may be carried out at approximately room temperature for 20 to 60 minutes, using a pressure kneader or automated mortar. After mixing, drying should preferably be carried out at approximately 100 to 300° C. for 20 to 60 minutes. When a thermosetting resin is used for the insulating material, setting proceeds during this drying process.

After drying followed by disintegration, if required, it is preferable to add a lubricant to the particles for the purpose of improving lubrication among the particles, and the releasability of the molded core from the mold.

After the second compression molding step is performed, usually, the insulating material resin is set by heat treatment to increase the mechanical strength of the core so that, for instance, a breakdown of the coil-embedded dust core can be prevented when the aforesaid terminal electrodes are bent. This heat treatment may be performed at approximately 100 to 300° C. for 10 to 30 minutes.

After the completion of the second compression molding step, if required, the coil-embedded dust core may be impregnated with a resin solution, which is then set to improve the mechanical strength of the core. For the resin used for this impregnation, a selection may be made from phenol resins, epoxy resins, silicone resins, acrylic resins, etc., although the phenol resins are preferred. No specific limitation is imposed on the solvent used for resin solution preparation; for instance, an approximate selection may be made from ordinary organic solvents such as ethanol, acetone, toluene and pyrrolidone depending on the resin used. When the impregnated resin is set by heat treatment, the heat-treatment temperature should preferably be 150 to 400° C. At too low a heat-treatment temperature, no sufficient improvements in the mechanical strength of the coil-embedded dust core are obtainable. At too high a temperature, on the other hand, the insulating effect becomes slender.

The coil-embedded dust core produced according to the present invention lends itself to a coil through which large currents conduct, and so may be suitable for various inductor devices such as choke coils, and various electromagnetic devices such power source coils. This may also be used in air bag sensor applications. The frequency at which the coil-embedded dust core is used is in the range of preferably 10 Hz to 1 MHz, and more preferably 500 Hz to 500 kHz.

Coil

No specific limitation is placed on the coil used in the present invention; use may be made of a coil similar to those in conventional coil-embedded dust cores. However, it is preferable to use a single-wound coil of flat shape in section, as already mentioned. The sectional area, and number of turns, of the coil may be appropriately determined in consideration of the demanded performance. The surface of the coil is usually provided with an insulating coating composed of a resin or an inorganic insulating material.

Ferromagnetic Metal Powders

No particular limitation is imposed on the ferromagnetic metal powders used herein. However, when the coil-embedded dust core of the present invention is used in applications where satisfactory direct-current superposition characteristics are needed at a high magnetic field, e.g., for a choke coil through which large currents pass, it is preferable to use ferromagnetic metal powders wherein particles having a circularity of 0.5 or less account for 20% or less, and preferably 15% or less of the total number of particles. The circularity is here defined by the following equation (I):

$$\text{Circularity}=4\pi S/L^2 \quad \text{(I)}$$

where S is the area of a projected image of a particle, and L is the length of the profile (or periphery) of the projected image. This projected image is a two-dimensional image obtained by projecting a three-dimensional particle onto a plane. In the present invention, a microscope photograph is first taken of powders, followed by image processing at need. Then, S and L are calculated from particle images on the photograph. For this measurement, it is not required to take photographs of all particles forming the powders; only a portion of the powders is needed. The number of particles to be measured should be preferably 50 or greater, and more preferably 100 or greater.

The projected image of a particle having a small circularity is of asperated indefinite shape whereas the projected image of a particle having a large circularity is of sharply defined shape such as circular, elliptical or array shape.

No particular limitation is placed on the type of the metal (in a metal or alloy form) forming the ferromagnetic metal powders; for instance, one or two or more may be selected from iron, iron silicide, permalloy (Fe—Ni), supermalloy (Fe—Ni—Mo), sendust, iron nitride, iron aluminum alloy, iron cobalt alloy, phosphor iron, etc. By way of example but not way of limitation, the ferromagnetic metal powders may be produced by an atomization process, an electrolytic decomposition process, a process of mechanically pulverizing electrolytic iron, and a pyrolytic decomposition process of carbonyl iron. A suitable process capable of obtaining particles having the desired shape may be selected from these processes. To obtain particles having a high circularity, however, it is preferable to use the atomization or pyrolytic decomposition process.

However, iron powders obtained by the pyrolysis of carbonyl iron have relatively large losses. Sendust powders must be compression molded at high pressure due to its increased hardness, and so make coils susceptible to deformation during compression molding. In the present invention, it is thus preferable to use a permalloy material comprising an alloy composed primarily of Fe and Ni.

The ferromagnetic metal powders should have a mean particle diameter of preferably 1 to 50 $\mu$m, and more preferably 3 to 40 $\mu$m. With too small a mean particle size, powders are of large coercive force, and difficult to handle. With too large a mean particle diameter, powders have increased eddy-current losses.

Insulating Material

No particular limitation is imposed on the insulating material used herein; at least one may be appropriately selected from various inorganic, and organic materials. To be more specific, an appropriate selection may be made from water glass, phenol resins, silicone resins, epoxy resins, metal oxide particles, etc. However, it is preferable to use resins, especially phenol resins and/or silicone resins.

Phenol resins are synthesized by reactions between phenols and aldehydes, and broken down into two types, one being a resol type resin synthesized using a base catalyst and the other being a novolak type resin obtained using an acid catalyst. The resol type resin is cured by heating or an acid catalyst into an insoluble, infusible resin. The novolak type resin is a soluble, fusible resin that undergoes no thermal curing by itself, and is cured if it is heated together with a crosslinking agent such as hexamethylene-tetramine. For the phenol resins, it is preferable to use the resol type resins, among which a resol type resin containing N in the form of tertiary amine is particularly preferred because of its satisfactory heat resistance. On the other hand, the use of the novolak type resin renders it difficult to handle a powder compact at steps after compression molding due to its decreased strength. When the novolak type resin is used, it is thus preferable to carry out molding (hot pressing or the like) at an applied temperature. Usually in this case, the molding temperature is between about 150° C. and about 400° C. The novolak type resin, if used, should preferably contain a crosslinking agent.

The starting materials for the synthesis of the phenol resins, for instance, include phenols such as phenol, cresols, xylenols, bisphenol A and resorcin, at least one of which should be used, and aldehydes such as formaldehyde, paraformaldehyde, acetaldehyde and benzaldehyde, at least one of which should be used.

The phenol resin used herein should have a weight-average molecular weight of preferably 300 to 7,000, more preferably 500 to 7,000, and even more preferably 500 to 6,000. The lower the weight-average molecular weight, the stronger the powder compact and so the less likely dusting is to occur from the edges of the powder compact. At a weight-average molecular weight of less than 300, however, there is an increase in the weight loss of the resin upon annealed at high temperature, which increase makes it impossible to keep insulation among the ferromagnetic metal particles in the coil-embedded dust core.

For the phenol resin, commercially available products may be used, for instance, BRS-3801 and ELS-572, 577, 579, 580, 582 and 583 (of the resol type) as well as BRP-5417 (of the novolak type), all made by Showa Kobunshi Co., Ltd.

The silicone resin used herein should preferably have a weight-average molecular weight of the order of 700 to 3,300.

The amount of the resin used as the insulating material should be preferably 1 to 30% by volume, and more preferably 2 to 20% by volume with respect to the ferromagnetic metal powders. When the amount of the resin used is too small, there is a decrease in the mechanical strength of the coil-embedded dust core, with an insulation failure. When the amount of the resin used is too large, on the other hand, the proportion of non-magnetic matters in the coil-embedded dust core becomes high, resulting in decreases in permeability and magnetic flux density.

When the insulating resin is mixed with the ferromagnetic metal powders, a solid or liquid resin may be used in a solution form, which is then mixed with the powders. Alternatively, the liquid resin may be directly mixed with the powders. The liquid resin should have a viscosity at 25° C.

of preferably 10 to 10,000 CPS, and more preferably 50 to 9,000 CPS. Any deviation from this viscosity range renders it difficult to provide a uniform coating on the surface of the ferromagnetic metal particle.

In this connection, it is understood that the aforesaid insulating material resin also functions as a binder to improve the mechanical strength of the coil-embedded dust core.

When the metal oxide particles are used as the insulting material, it is preferable to make use of a titanium oxide sol and/or a zirconium oxide sol. In the titanium oxide sol, negatively charged titanium oxide particles of indefinite shape are dispersed in water or an organic dispersing medium to form a colloidal dispersion. In the zirconium oxide sol, too, negatively charged zirconium oxide particles of indefinite shape are dispersed in water or an organic dispersing medium to form a colloidal dispersion. —TiOH groups are found on the surfaces of the titanium oxide particles, and —ZrOH groups are existing on the surfaces of the zirconium oxide particles. By adding to the ferromagnetic metal powders the sol with minute particles uniformly dispersed in the solvent such as the titanium oxide sol or zirconium oxide sol, it is possible to achieve high magnetic flux density and improved insulation because uniform insulating coatings can be formed in small amounts.

The titanium oxide particles, and zirconium oxide particles contained in the sol should have a mean particle diameter of preferably 10 to 100 nm, more preferably 10 to 80 nm, and even more preferably 20 to 70 nm. The content of the particles in the sol should preferably be of the order of 15 to 40% by weight.

The amount, as calculated on a solid basis, of the titanium oxide sol, and zirconium oxide sol added to the ferromagnetic metal powders, i.e., the total amount of the titanium oxide particles, and zirconium oxide particles added should be preferably 15% by volume or less, and more preferably 5.0% by volume or less. When the total amount is too large, the proportion of non-magnetic matters in the coil-embedded dust core becomes high, resulting in decreases in permeability and magnetic flux density. To take full advantage of the sol added, the aforesaid total amount should be preferably 0.1% by volume or greater, more preferably 0.2% by volume or greater, and even more preferably 0.5% by volume or greater.

The titanium oxide sol and zirconium oxide sol may be used alone, or in combination at any desired quantitative ratio.

For these sols use may be made of commercially available products (e.g., NZS-20A, NZS-30A, and NZS-30B, all made by Nissan Chemical Industries, Ltd.). When an available sol product has a low pH value, it is preferable to regulate the value to about 7. At too low a pH value, the ferromagnetic metal powders are so oxidized that the proportion of non-magnetic oxides increases, possibly ending up with decreases in permeability and magnetic flux density or a deterioration in coercive force.

These sols are broken down into two types, one being of the aqueous solvent type and the other being of the non-aqueous solvent type. The solvent used should preferably be compatible with the resin used in combination therewith, and so particular preference is given to the non-aqueous solvent type sol wherein ethanol, butanol, toluene, xylene or other solvents are used. When an available sol is of the aqueous solvent type, it is acceptable to substitute that solvent by a non-aqueous solvent at need.

The sol used may contain chlorine ions, ammonia or the like in the form of a stabilizer.

These sols are usually available in a translucent white colloidal state.

Lubricant

The lubricant is used to improve lubrication among the particles during molding and improve the releasability of the dust core from the mold. For the lubricant, it is preferable to use at least one selected from aluminum stearate, magnesium stearate, calcium stearate, strontium stearate, barium stearate and zinc stearate.

The content of such a metal stearate should be preferably 0.2 to 1.5% by weight, and more preferably 0.2 to 1.0% by weight with respect to the ferromagnetic metal powders. When this content is too small, some problems arise; for instance, insulation among the ferromagnetic metal particles in the coil-embedded dust core becomes insufficient, and difficulty is experienced in releasing the coil-embedded dust core from the mold after molding. When the content is too large, on the other hand, the proportion of non-magnetic matters in the coil-embedded dust core increases, resulting in decreasing permeability and magnetic flux density. In addition, the strength of the coil-embedded dust core tends to become insufficient.

Besides the aforesaid metal stearates, it is acceptable to use as the lubricant other metal salts of higher fatty acids, especially a metal laurate. However, the amount of the metal salts used should not be in excess of 30% by weight of the amount of the metal stearates used.

EXAMPLE

Example 1

A coil-embedded dust core sample was prepared according to the following procedures.

The following starting materials were provided.

Figure 6:
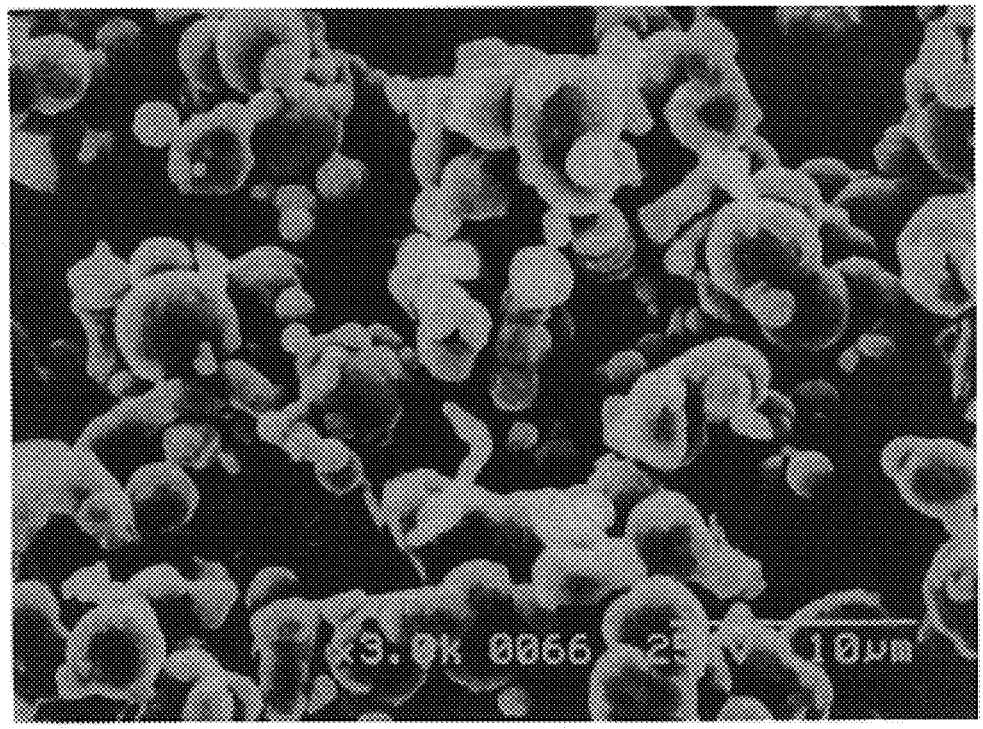
FIG. 6 is a drawing substitute illustrative of a particle structure, i.e., a photograph of magnetic powders taken through a scanning electron microscope.

Magnetic powders: Fe powders produced by pyrolysis of carbonyl iron (made by GAF Co., Ltd. with a mean particle diameter of 5 $\mu$m and the number of particles having a circularity of 0.5 or less accounting for 1% of all particles, Insulating material: a phenol resin of the resol type (ELS-582 made by Showa Kobunshi Co., Ltd. with a weight-average molecular weight of 1,500), and Lubricant: strontium stearate (made by Sakai Chemical Industries, Ltd.). The circularity of the magnetic powders were measured using an SEM (scanning electron microscope) photograph. The number of the particles measured was 100. The SEM photograph of the magnetic powders is attached hereto as FIG. 6.

Then, the insulating material was added to the magnetic powders in an amount of 8% by volume with respect thereto, whereupon these were mixed together in a pressure kneader at room temperature for 30 minutes. Subsequently, the mixture was dried in air at 150° C. for 30 minutes, thereby obtaining magnetic powders comprising particles coated with the insulating material. The lubricant in an amount of 0.8% by weight with respect to the magnetic powders was added to the mixture after drying, and the mixture was mixed together in a V-mixer for 15 minutes.

Then, one portion of the magnetic powders was charged in a molding die (mold), as shown in FIG. 1A, wherein the first compression molding was carried at an applied pressure ($P_1$) of 150 MPa to form a lower core 2. Subsequently, a double-wound coil 3 of 4.5 turns of a copper wire having a diameter of 0.7 mm was positioned on the lower core 2, while both ends of the coil 3 was interposed and fixed between double-split frame 5 parts, as shown in FIG. 1B. Subsequently, another portion of the magnetic powders 10 was charged in the mold to embed the coil 3 in the magnetic powders, as shown in FIG. 1C. Then, the second compression molding was carried out at an applied pressure of 200 MPa ($P_2$), whereupon the insulating material resin was cured by a 10-minute heat treatment at 200° C. to cure the insulating material resin, thereby obtaining a cylindrical coil-embedded dust core sample of 12 mm in diameter and 3 mm in height. The molding pressure ratio, $P_2/P_1$, was 1.33.

An X-ray projection photograph was taken of this sample to check where the coil was located in the sample. As a result, the coil was substantially prevented from going down and there was no misalignment of the coil in a plane perpendicular to the direction of application of pressure. Upon inspection of a cut section of the sample, slight voids were found all over the surface of the juncture of the upper and lower cores.

Example 2

A coil-embedded dust core sample was prepared according to the following procedures.

The following starting materials were provided.

Magnetic powders: permalloy powders produced by an atomization process (having a mean particle diameter of 25 μm with the number of particles having a circularity of 0.5 or less accounting for 18% of all particles), Insulating material: a silicone resin (SR2414LV made by Toray Dow Corning Silicone Co., Ltd.), and Lubricant: aluminum stearate (made by Sakai Chemical Industries, Ltd.). The circularity of the magnetic powders were measured using an SEM (scanning electron microscope) photograph. The number of the particles measured was 100.

Then, the insulating material was added to the magnetic powders in an amount of 8% by volume with respect thereto, whereupon these were mixed together in a pressure kneader at room temperature for 30 minutes. Subsequently, the mixture was dried in air at 150° C. for 30 minutes, thereby obtaining magnetic powders comprising particles coated with the insulating material. The lubricant in an amount of 0.4% by weight with respect to the magnetic powders was added to the mixture after drying, and the mixture was mixed together in a V-mixer for 15 minutes.

According to the aforesaid procedures shown in FIGS. 5A to 5I, the coil-embedded dust core sample was then prepared. The first compression molding step was carried out at an applied pressure, $P_1$, of 140 MPa while the second compression molding step was done at an applied pressure, $P_2$, of 440 MPa. The molding pressure ratio, $P_2/P_1$, was 3.14. For a coil 3, a single-wound coil of 2.6 turns of a copper wire of rectangular shape (0.3 mm×2.5 mm) in section was used. After the completion of the second compression molding step, the insulating material resin was cured by a 10-minute heat treatment at 200° C. The obtained sample was in a cuboidal form of 12.5 mm×12.5 mm in planar size and 3.3 mm in thickness Dh. This sample was used as an inventive sample. Since the coil positioning surface 21 of the lower core 2 was of 0.9 mm in height Bh and the apex height, Ch, of the inner protrusion 22 and outer protrusion 23 was 2.4 mm, $$Bh/Dh=0.27$$

$$Ch/Dh=0.73$$

In this sample, no crack was found between the lower core and the upper core. Upon bending of the terminal electrodes after sample preparation, no crack was observed.

On the other hand, another sample was prepared as in the aforesaid inventive sample provided that $P_1=P_2=440$ MPa. In this second sample, cracks were found all over the surface of the juncture of the upper core and lower core.

Then, one portion of the magnetic powders was filled in the mold to make their surfaces flat, whereupon another portion of the magnetic powders was filled therein while a lead frame was sandwiched between the upper frame and the lower frame. In this state, one single compression molding was carried out at a pressure of 440 MPa to prepare a coil-embedded dust core sample having the same size as the aforesaid inventive sample. This was used as a comparative sample.

Figure 7:
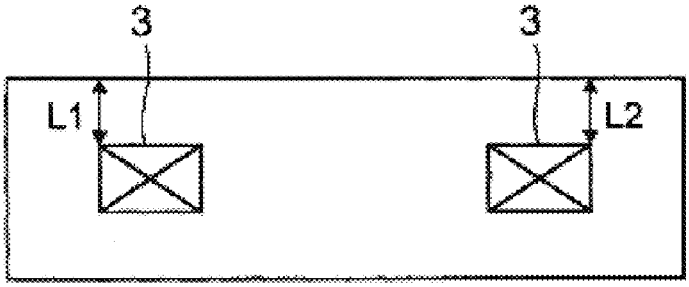
FIG. 7 is a sectional representation of the dust core.

Photographs were taken of cut sections of both samples. With the obtained photographs, where the coil was located in each sample was checked. In this case, the position of the coil was identified by distances L1 and L2 on the core section shown in FIG. 7. The results are shown in Table 1.

TABLE 1

| | Inventive Sample | Comparative Sample |
|---|---|---|
| L1 (mm) | 1.111 | 1.110 |
| L2 (mm) | 1.088 | 0.8610 |

From Table 1, it is understood that in the inventive sample, the coil is located substantially at the center thereof whereas in the comparative sample, the coil is located off the center thereof. In the comparative sample, a large misalignment (vertical misalignment) was thus observed in the direction of application of pressure.

Then, a group of 10 inventive samples prepared under the same conditions as in the aforesaid inventive sample and a group of 10 comparative samples prepared under the same conditions as in the aforesaid comparative sample were measured at 0.5 V and 100 kHz for their inductance values with or without direct-currents of 10 A or 20 A superposed thereon. From the maximum and minimum inductance values in each group, the average value and the difference between the maximum value and the minimum values were found. The results are shown in Table 2. The values given in Table 2 are direct-current superposition current values.

TABLE 2

| | Inductance (μH) | | | | | |
|---|---|---|---|---|---|---|
| | 0A | | 10A | | 20A | |
| | Average | Difference | Average | Difference | Average | Difference |
| Inventive | 0.784 | 0.015 | 0.723 | 0.014 | 0.652 | 0.009 |
| Comparative | 0.650 | 0.137 | 0.615 | 0.137 | 0.586 | 0.134 |

From Table 2, the effects of the present invention can be clearly understood. In other words, the difference in inductance between the maximum and the minimum in the inventive sample group is about 1/10 of that in the comparative sample group, and so is very limited. It is thus evident that inductance variations can be much more improved by the present invention. The inventive sample group is also larger in the average inductance value than the comparative sample group. This is because in the comparative sample group the core are located nearer to one side of the dust core, resulting in local magnetic saturation.

Japanese Patent Application Nos. 003506/2000 and 371541/2000 are herein incorporated by reference.

The invention has been described with particular reference to certain preferred embodiments; however, it will be understood that variations and modifications may be effected within the spirit and scope of the invention.

What we claim is:

1. A process for producing a coil-embedded dust core by embedding a coil in magnetic powders comprising ferromagnetic metal particles coated with an insulating material, comprising:

a first compression molding step wherein one portion of magnetic powders is filled in a molding die and then compression molded to form a lower core, a coil positioning step wherein said coil is positioned on an upper surface of said lower core in said molding die, a coil embedding step wherein another portion of magnetic powders is again filled in said molding die in such a way that said coil is embedded in these magnetic powders, and a second compression molding step wherein pressure is applied to said lower core and said coil in a direction of lamination thereof, wherein said coil is a single-wound coil formed of a conductor wire of flat shape in section, said conductor wire is wound in such a way that a major diameter direction of said flat section is perpendicular with respect to an axial direction of said coil, said conductor wire is fixed at one end and another end with terminal electrodes, respectively, and where said coil is positioned on the upper surface of said lower core, the terminal electrode located relatively near to said lower core is positioned on an upper surface of said conductor wire while the terminal electrode located relatively far away from said lower core is positioned on a lower surface of said conductor wire.

2. The coil-embedded dust core production process according to claim 1, wherein the upper surface of said lower core is provided with at least one protrusion that is located on an inner and/or outer periphery of said coil.

3. The coil-embedded dust core production process according to claim 1, wherein the ferromagnetic metal particles used are formed of an alloy composed primarily of Fe and Ni.

4. A coil-embedded dust core produced by the production process according to claim 1.

5. A process for producing a coil-embedded dust core by embedding a coil in magnetic powders comprising ferromagnetic metal particles coated with an insulating material, comprising:

a first compression molding step wherein one portion of magnetic powders is filled in a molding die and then compression molded to form a lower core, a coil positioning step wherein said coil is positioned on an upper surface of said lower core in said molding die, a coil embedding step wherein another portion of magnetic powders is again filled in said molding die in such a way that said coil is embedded in these magnetic powders, a second compression molding step wherein pressure is applied to said lower core and said coil in a direction of lamination thereof, wherein the upper surface of said lower core is provided with at least one protrusion that is located on an inner and/or outer periphery of said coil, and at least one of said protrusions, $Ch \neq Dh/2$, where Ch is a non-zero height of said protrusion, and Dh is a non-zero height of the coil-embedded dust core to be produced.

6. The coil-embedded dust core production process according to claim 5, wherein the upper surface of said lower core is provided with at least one protrusion that is located on an inner and/or outer periphery of said coil.

7. The coil-embedded dust core production process according to claim 5, wherein the ferromagnetic metal particles used are formed of an alloy composed primarily of Fe and Ni.

8. A coil-embedded dust core produced by the production process according to claim 5.

9. A process for producing a coil-embedded dust core by embedding a coil in magnetic powders comprising ferromagnetic metal particles coated with an insulating material, comprising:

a first compression molding step wherein one portion of magnetic powders is filled in a molding die and then compression molded to form a lower core, a coil positioning step wherein said coil is positioned on an upper surface of said lower core in said molding die, a coil embedding step wherein another portion of magnetic powders is again filled in said molding die in such a way that said coil is embedded in these magnetic powders, and a second compression molding step wherein pressure is applied to said lower core and said coil in a direction of lamination thereof, wherein $Bh \neq Dh/2$, where Bh is a non-zero height of a surface of said lower core on which said coil is positioned, and Dh is a non-zero height of the coil-embedded dust core to be produced.

10. The coil-embedded dust core production process according to claim 9, wherein the upper surface of said lower core is provided with at least one protrusion that is located on an inner and/or outer periphery of said coil.

11. The coil-embedded dust core production process according to claim 9, wherein the ferromagnetic metal particles used are formed of an alloy composed primarily of Fe and Ni.

12. A coil-embedded dust core produced by the production process according to claim 9.

13. A process for producing a coil-embedded dust core by embedding a coil in magnetic powders comprising ferromagnetic metal particles coated with an insulating material, comprising:

a first compression molding step wherein one portion of magnetic powders is filled in a molding die and then compression molded to form a lower core, a coil positioning step wherein said coil is positioned on an upper surface of said lower core in said molding die, a coil embedding step wherein another portion of magnetic powders is again filled in said molding die in such a way that said coil is embedded in these magnetic powders, and a second compression molding step wherein pressure is applied to said lower core and said coil in a direction of lamination thereof, wherein the magnetic powders comprise the ferromagnetic metal particles where a number of the ferromagnetic metal particles having a circularity of 0.5 or less as defined by the following equation (I) accounts for 20% or less of all the ferromagnetic metal particles:

$$\text{circularity}=4\ \pi S/L^2 \qquad \text{(I)}$$

where S is a non-zero area of a projected image of a particle, and L is a non-zero length of a profile of said projected image.

14. The coil-embedded dust core production process according to claim 13, wherein the upper surface of said lower core is provided with at least one protrusion that is located on an inner and/or outer periphery of said coil.

15. The coil-embedded dust core production process according to claim 13, wherein the ferromagnetic metal particles used are formed of an alloy composed primarily of Fe and Ni.

16. A coil-embedded dust core produced by the production process according to claim 13.

* * * * *